US008199090B2

(12) United States Patent
Tung et al.

(10) Patent No.: US 8,199,090 B2
(45) Date of Patent: Jun. 12, 2012

(54) GAMMA CORRECTION APPARATUS AND A METHOD OF THE SAME

(75) Inventors: Jen-Lang Tung, Kaohsiung (TW); Yu-Wen Lin, Taichung Hsien (TW)

(73) Assignee: Au Optronics Corporation, Hsinchu (TW)

( * ) Notice: Subject to any disclaimer, the term of this patent is extended or adjusted under 35 U.S.C. 154(b) by 226 days.

(21) Appl. No.: 12/481,188

(22) Filed: Jun. 9, 2009

(65) Prior Publication Data

US 2009/0273551 A1 Nov. 5, 2009

Related U.S. Application Data

(63) Continuation of application No. 10/867,673, filed on Jun. 16, 2004, now Pat. No. 7,649,541.

(30) Foreign Application Priority Data

Nov. 21, 2003 (TW) ..... 92132807 A

(51) Int. Cl.
*G09G 3/36* (2006.01)

(52) U.S. Cl. ..... 345/88; 345/690

(58) Field of Classification Search ..... 345/87, 345/612, 690, 100, 88, 8, 98, 99; 349/108
See application file for complete search history.

(56) References Cited

U.S. PATENT DOCUMENTS

| | | | | |
|---|---|---|---|---|
| 5,386,247 | A | 1/1995 | Shafer et al. | |
| 5,475,402 | A * | 12/1995 | Hijikata | 345/211 |
| 6,078,361 | A * | 6/2000 | Reddy | 348/558 |
| 6,784,861 | B2 * | 8/2004 | Okada | 345/87 |
| 6,870,576 | B2 | 3/2005 | Park | |
| 6,879,310 | B2 | 4/2005 | Nose | |
| 7,002,594 | B2 | 2/2006 | Yoshida et al. | |
| 7,173,597 | B2 * | 2/2007 | Kato | 345/99 |
| 7,336,327 | B2 * | 2/2008 | Otagiri et al. | 349/106 |
| 7,492,379 | B2 * | 2/2009 | Credelle et al. | 349/106 |

FOREIGN PATENT DOCUMENTS

| | | |
|---|---|---|
| JP | 9218668 | 8/1997 |
| JP | 2000330091 | 11/2000 |
| JP | 2001134242 | 5/2001 |
| TW | 511066 | 11/2002 |

OTHER PUBLICATIONS

Tung, et al., Non-Final Office Action mailed Mar. 5, 2008, filed Jun. 16, 2004, U.S. Appl. No. 10/867,673.
Tung, et al., Non-Final Office Action mailed Sep. 17, 2008, filed Jun. 16, 2004, U.S. Appl. No. 10/867,673.
Tung, et al., Final Office Action mailed Mar. 3, 2009, filed Jun. 16, 2004, U.S. Appl. No. 10/867,673.

* cited by examiner

*Primary Examiner* — Abbas Abdulselam
(74) *Attorney, Agent, or Firm* — Thomas, Kayden, Horstemeyer & Risley, LLP

(57) ABSTRACT

A gamma correction apparatus comprising a digital to analog converter (DAC), a plurality of compensating circuits, and at least one adjusting circuit is provided. The DAC is used to receive RGB digital signals to further generate analog signals. The analog signals are then transferred to the relative pixel devices through the signal lines on the LCD panel. The compensating circuits inserted between the DAC and the signal lines are used to adjust the analog signals to correct the displaying brightness of the pixel devices. The adjusting circuit connecting to the compensating circuits is used to control the operation of the compensation circuits. In addition, a method for adjusting gamma curves by providing three common voltage levels related to RGB colors individually is also provided to achieve better white balance.

18 Claims, 4 Drawing Sheets

GAMMA CORRECTION APPARATUS AND A METHOD OF THE SAME

CROSS-REFERENCE TO RELATED APPLICATION

The present application is a continuation of application Ser. No. 10/867,673, now U.S. Pat. No. 7,649,541, filed Jun. 16, 2004.

BACKGROUND OF THE INVENTION

1. Field of the Invention

This invention relates to an apparatus for improving color correctness of an LCD, and particularly to a gamma correction apparatus for adjusting gamma curve separation to improve color correctness.

2. Description of Related Art

Along with enormous promotions of thin film transistor (TFT) fabrication technique, liquid crystal displays (LCD) are broadly applied to personal digital assistants (PDA), notebooks (NB), digital cameras (DC), digital videos (DV), mobile phones, etc. In order to form images, a liquid crystal (LC) driving circuit is usually used in an LCD to decode input signals so as to form displaying data and scanning data, and further to control the displaying of the LCD.

FIG. 1 depicts a relationship of transparency of typical red ("R"), green ("G"), and blue ("B") pixel devices with respect to the applied electric field. Three separate data curves in FIG. 1 imply that the LC layer in the pixel devices presents various refractivity and retardation values with respect to the passing-through visible light beam under some identical applied electric fields. That is, the RGB pixel devices show different transparency.

Generally, in order to provide a quality look-up feeling to human eyes, a gamma curve of FIG. 2, compared with the graph of FIG. 1, shows a relationship between transparency and bit numbers of the pixel devices, wherein the bit number represents the brightness feeling of human eyes. As shown in FIG. 2, the RGB gamma curves are separated to each other, by which it would be difficult to keep the combination of RGB illumination at a preset white-balance point. Also, bias in image will definitely exist in response to the inputted displaying signals.

In the art to solve the separation problem in gamma curves as shown in FIG. 1, a typical method to have the R, G, and B pixel devices operate at different LC layer thicknesses is usually adopted. FIG. 3 depicts a schematic cross-section view of such RGB pixel devices in accordance with the method targeting on varying LC layer thickness. As shown, each pixel device comprises an upper substrate 100, a lower substrate 300, and an interposed LC layer 200. The upper substrate 100 has a color filter layer 110 formed on a lower surface thereof to let the pixel device shows a preset color. The lower substrate 300 has a transparency organic layer 312 formed on an upper surface thereof. Pairing of a pixel electrode layer 310 formed on the transparency organic layer 312 and a common electrode layer 120 under the color filter layer 110 represents an electric field E to drive the LC layer 200. Furthermore, two alignment films 130 and 320 are formed respectively on the inner surfaces of the common electrode layer 120 and the pixel electrode layer 310 to set the orientation of the LC layer 200. As shown, the RGB pixel devices assign various thicknesses to the organic layers 312 so as to vary local thickness of the LC layer 200.

It is well understood that the spacing between the pixel electrode layer 310 and the common electrode layer 120 can severely affect the strength of the electric field E formed in the LC layer 200. Also, it is clear that the thickness of the LC layer 200 and the strength of the electric field E are both related to the transparency of the LC layer 200. Therefore, by assigning different thicknesses to the color filters 110 or the transparency organic layers 312 in the RGB pixel devices, the transparency of the LC layer 200 can then be adjusted and thereby the RGB gamma curves as shown in FIG. 1 can have better coherence.

However, the above-described gamma adjusting method has the following drawbacks.

1. For additional steps of forming transparency organic layers 312 with different thicknesses are demanded before the step of forming the pixel electrode layer 310, so the fabrication cost will definitely increase.

2. The transparency layers 312 with various thicknesses are provided with a rough upper surface on which the alignment film 320 is hard to form.

3. The pixel electrode layer 310 on the transparency organic layers 312 is formed on a rough surface. Therefore, a lateral electric field may exist between the neighboring pixel electrodes, and thus disturbs normal operation of the pixel devices.

4. Because the color filter layers 110 absorb part of the illumination passing through, the RGB pixel devices may present different displaying brightness due to the thickness variation of the color filter layers 110. Moreover, the color filter layers 110 are also provided with a rough exposed surface, which may make it difficult to form the alignment film 130 thereon.

The above-described gamma correction method utilizes structural change, particularly in the LC layer thickness, upon the pixel devices to overcome possible curve-separation phenomenon shown in FIG. 1. On the other hand, another method for adjusting gamma curves by compensating the level of digital displaying signals is also available in the art. The method proceeds by increasing or decreasing the levels of RGB digital displaying signals to some extent before they are converted into analog ones for driving the pixel devices. However, limited segmentations upon the levels may put some close but different inputted digital displaying signals to have an identical output. Therefore, some displaying levels may be sacrificed and also the color resolution of the LCD would be declined.

Other than the above-described method, another gamma correction method is introduced to utilize a technique of adjusting the reference electric levels applied when the digital displaying signals are converted into analog ones. As mentioned, the reference electric level builds up the relationship between the digital displaying signals and the analog ones, and thus it may influence the output analog signals. However, empirically, because the level of digital displaying signal versus the transparency of the LC layer presents a non-linearly relationship, a demand of dynamic adjustment circuits to calibrate the reference electric levels is highly expected.

In order to build up the so-called non-linearly relationship, there needs at least one adjustable reference electric level circuits respect to R, G, B displaying colors, and each of the reference electric level circuits should be able to adjust the corresponding reference electric level from the level of the lowest digital displaying signal to the highest displaying signal. Therefore, an enormous amount of adjustable levels are needed for each the reference electric level circuit and thus complicates the corresponding LC driving circuit.

SUMMARY OF THE INVENTION

Accordingly, an object of the present invention is to provide a gamma correction apparatus and a method of the same, which directed solely to RGB gamma curve separation event resulted when visible light of different wavelength passing through an LC layer.

The gamma correction apparatus according to the present invention comprises a digital to analog converter (DAC), a plurality of compensating circuits, and at least one adjusting circuit. The DAC is used to receive RGB digital signals and further to generate analog signals. The analog signals are then transferred to the relative pixel devices through the signal lines on the LCD panel. The compensating circuits electrically connecting to the DAC and the signal lines are used to adjust the analog signals so as to correct the displaying brightness of the pixel devices. The adjusting circuit electrically connecting the compensating circuits is used to control the operation of the compensation circuits.

In addition, the present invention also provides a method for adjusting gamma curves of RGB illumination by providing three adjustable common voltage levels, each of which is related to a set of pixel devices of the same displaying color.

Reference will now be made in detail to the preferred embodiments of the present invention, examples of which are illustrated in the accompanying drawings. Wherever possible, the same reference numbers will be used throughout the drawings to refer to the same or like parts.

BRIEF DESCRIPTION OF THE DRAWINGS

The present invention will now be specified with reference to its preferred embodiment illustrated in the drawings, in which.

DETAIL DESCRIPTION OF THE PREFERRED EMBODIMENTS

Figure 4:
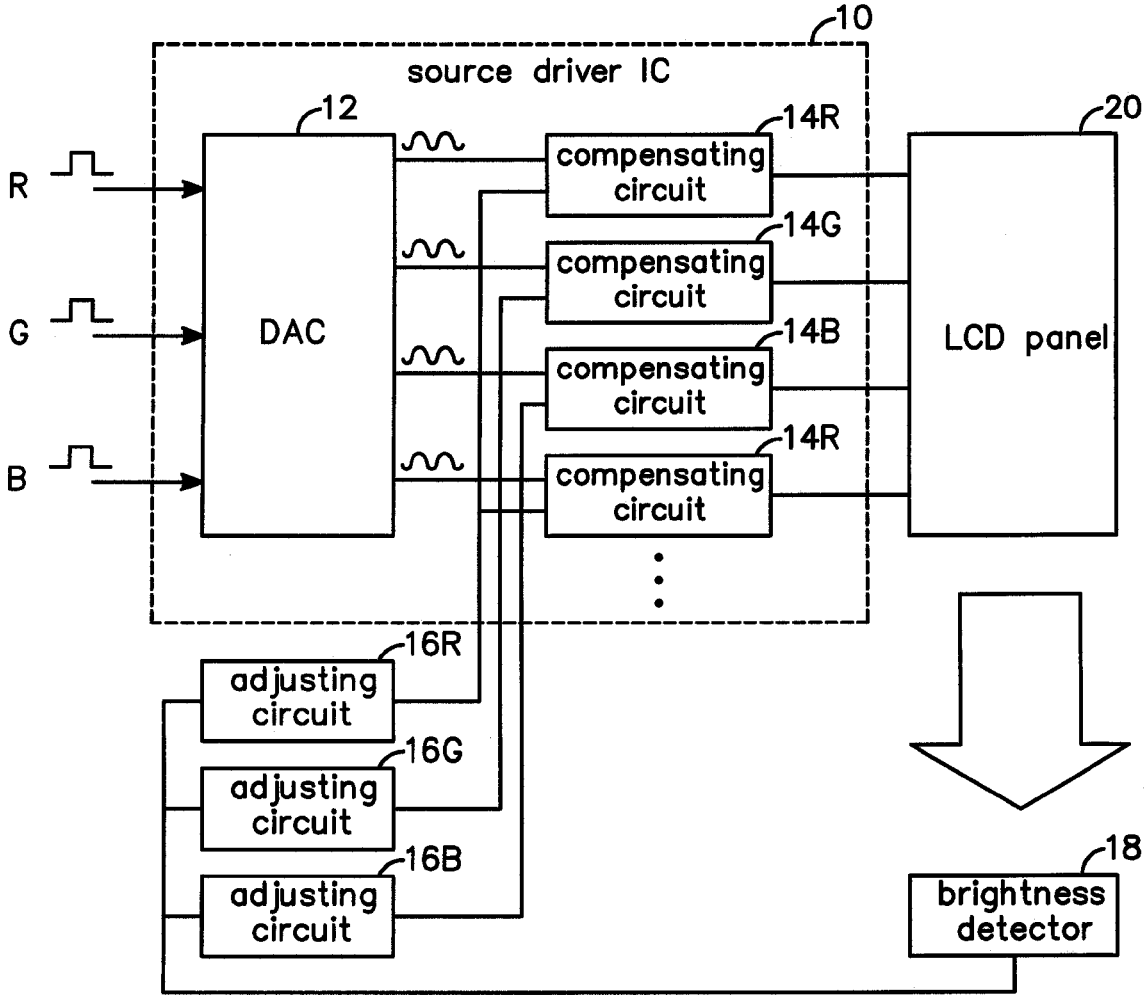
FIG. 4 depicts a schematic view of a preferred embodiment of the gamma correction apparatus in accordance with the present invention.

FIG. 4 is a schematic view of a gamma correction apparatus in accordance with the present invention. The gamma correction apparatus comprises a digital to analog converter (DAC) 12, a plurality of compensating circuits 14, and three adjusting circuits 16. The DAC 12 receives a clock signal and RGB displaying signals to generate analog signals. The analog signals are then sent to corresponding pixel devices through the signal lines (not shown in this figure) on the LCD panel 20 so as to generate corresponding electric potentials to drive the relative pixel devices. The compensating circuits 14 for adjusting the illumination of the pixels by changing the strength of the analog signals passed by are electrically connected to the rear end of the DAC 12 and the front end of the signal lines.

The three adjusting circuits 16R, 16G, 16B related to red ("R"), green ("G"), and blue ("B") respectively couple to the compensating circuits 14 for controlling the operation of the compensating circuits 14. Each of the adjusting circuits 16 has an adjustable resistor (not shown in this figure), which can be manually adjusted to have a changeable output for controlling the compensating circuits 14. In addition, the adjusting circuits 16 may deal with RGB illumination levels of the LCD panel 20, which is detected by a brightness detector 18, to automatically control the compensation the compensating circuits 14 give.

Generally, the adjusting circuits 16 are formed on a print circuit board (PCB), whereas the DAC 12 and the compensating circuits 14 are formed on a source driver IC 10, which is assembled between the PCB and the LCD panel 20. However, it is realized that the adjusting circuits 16 may be formed on the source driver IC and the compensating circuits 14 may be formed on the PCB if needed. Furthermore, with the help of low temperature polysilicon (LTPS) fabrication process, the adjusting circuits 16 or the compensating circuits 14 may be fabricated on the glass LCD panel 20 directly. Besides, the adjusting circuits 14 and the compensating circuits 16 may be provided in a single electric circuit on the source driver IC to simplify circuit layout.

Figure 5:
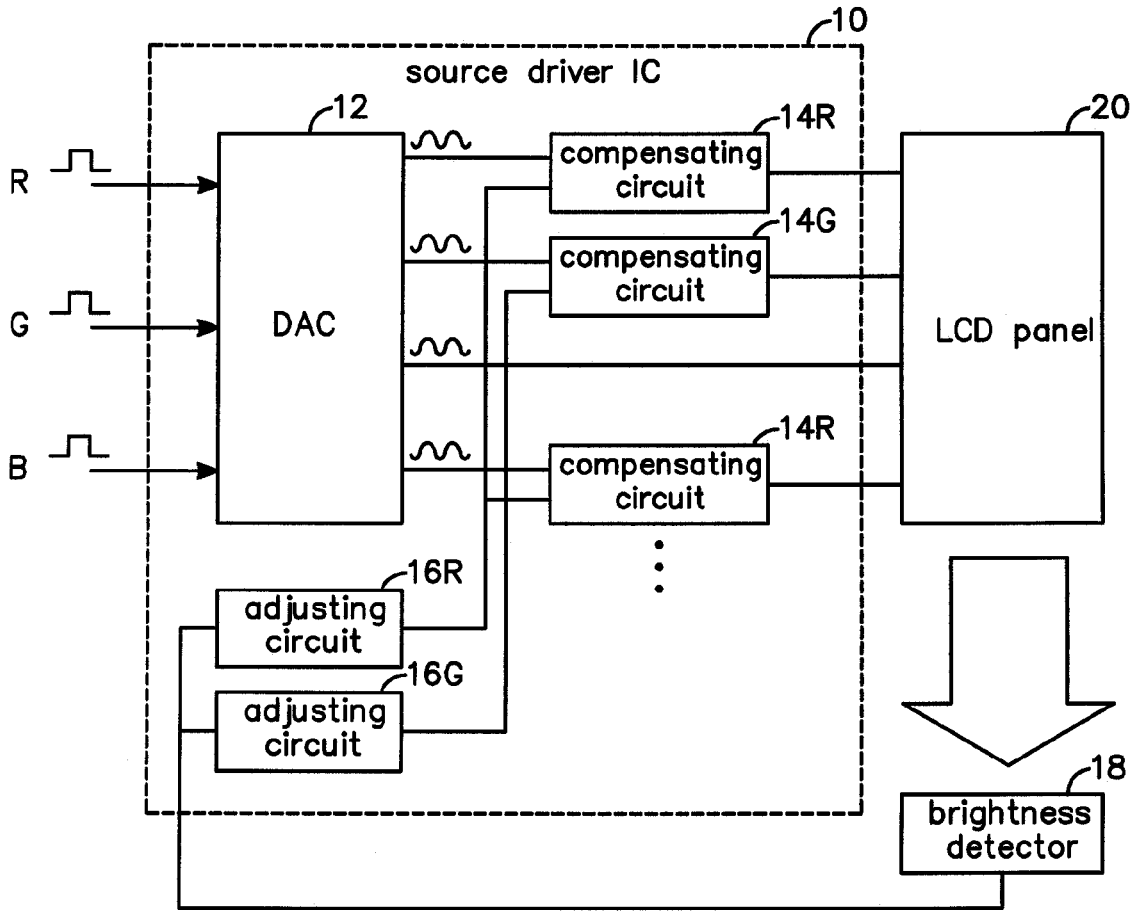
FIG. 5 depicts a schematic view of another embodiment of the gamma correction apparatus in accordance with the present invention.

Because relative brightness rather than absolute brightness of RGB colors is of mainly concern of gamma correction, one of the RGB colors may be preferably set as a reference color and thus only the displaying signals of the other two colors needs to be adjusted. For example, in an embodiment shown in FIG. 5, blue is set as a reference color, and thus only two sets of compensating circuits 14R, 14G and two adjusting circuits 16R, 16G are needed for achieving the goal of gamma correction.

In still another embodiment of the present invention, three sets of separated upper electrodes are formed to replace the so-called common electrode in a conventional LCD panel. Therefore, three adjustable common voltage levels, each of which is related to a set of pixel devices with the same displaying color, can be applied on the LCD panel at the same time.

Figure 6A:
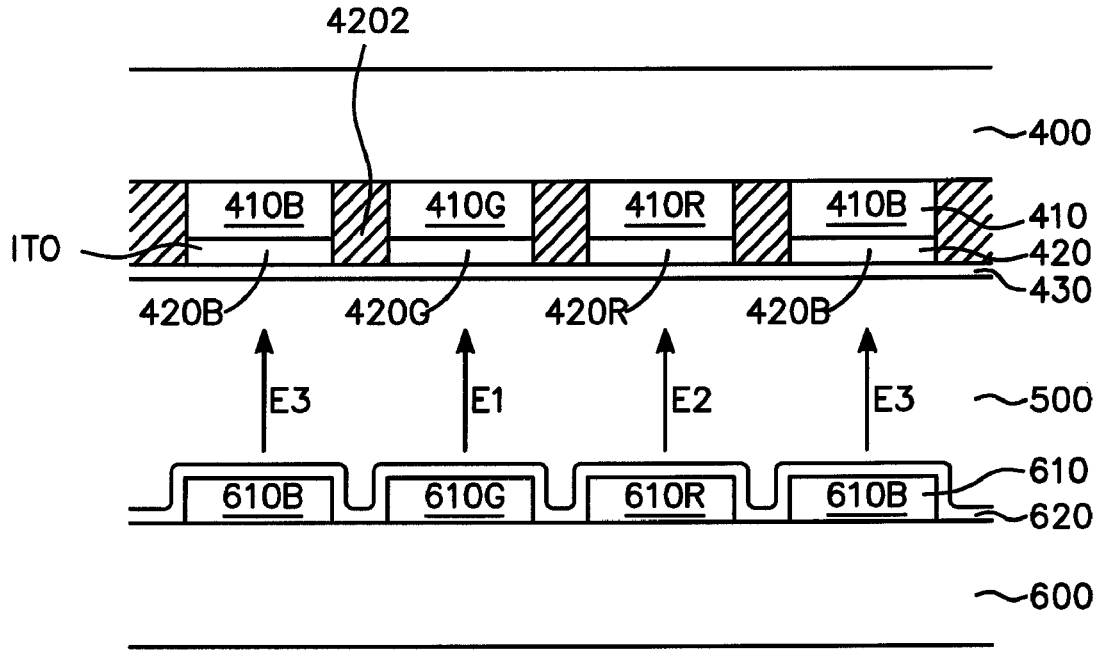
FIGS. 6A and 6B depict schematic views of another embodiment of the LCD, which is able to correct RGB gamma curves.
Figure 6B:
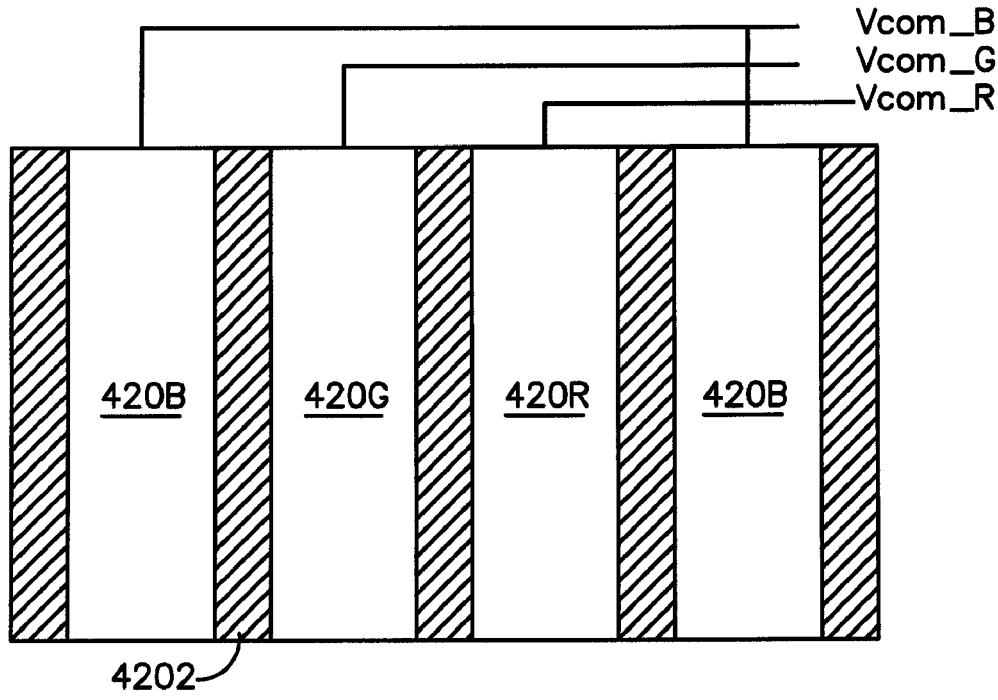

FIGS. 6A and 6B are schematic views of an LCD panel with a gamma correction apparatus for adjusting gamma curves of RGB illumination in accordance with the present invention. The LCD panel comprises a lower substrate 600, an upper substrate 400, and an interposed LC layer 500. A plurality of grid-arrayed lower electrodes 610 is formed on an upper surface of the lower substrate 600 for providing an operation voltage to the LC layer 500 according to the displaying signals. Besides, an alignment layer 620 is form on an upper surface of the lower electrodes 610 to have the liquid crystal molecule rotate to a preset direction. Color filters 410R, 410G, 410B are formed on a lower surface of the upper surface 400, and an upper electrode 420 is formed on a lower surface of the color filters 410R, 410G, 410B. The upper electrode 420 is separated into three sets of isolated bar-type blocks 420R, 420G, 420B, and another alignment layer 430 is formed on a lower surface of the upper electrode 420 to have the liquid crystal molecule rotate to a preset direction. Each of the bar-type blocks 420R, 420G, 420B faces a row of the grid-arrayed lower electrodes 610R, 610G, 610B, and the lower electrodes 610 of the same row relate to the same displaying color. Moreover, in order to have each block 420 isolated perfectly, a passivation wall 4202 is interposed between the neighboring blocks 420 to prevent the formation of lateral electric field.

As shown in FIG. 6B, three different common voltage levels, Vcom_R, Vcom_G, Vcom_B, are applied to the blocks 420R, 420G, 420B relatively. The three common voltage levels Vcom_R, Vcom_G, Vcom_B can be adjusted individually to form different electric fields E1, E2, E3 inside the LC layer 500 of the pixel devices with different displaying colors. Therefore, the transparency of the LC layer 500 of pixel devices with different displaying colors can be adjusted individually, and the relative illumination of RGB colors can be adjusted to achieve white balance.

Furthermore, each of the three upper electrodes needs a connected control circuit to adjust the common voltage level. In a preferred embodiment, an adjustable resistor may be used in the control circuit to allow manually adjusting event. In addition, the control circuit may deal with RGB illumination levels detected by a brightness detector so as to automatically adjust the output common voltage level.

By contrast to a traditional gamma correction apparatus, the apparatus and the method in accordance with the present invention have the following advantages.

1. In accordance with the present invention, a circuit-related improvement is the only need for adjusting RGB gamma curves, and thus no mechanical design, which increases the fabrication cost, needs to be introduced.

Figure 1:
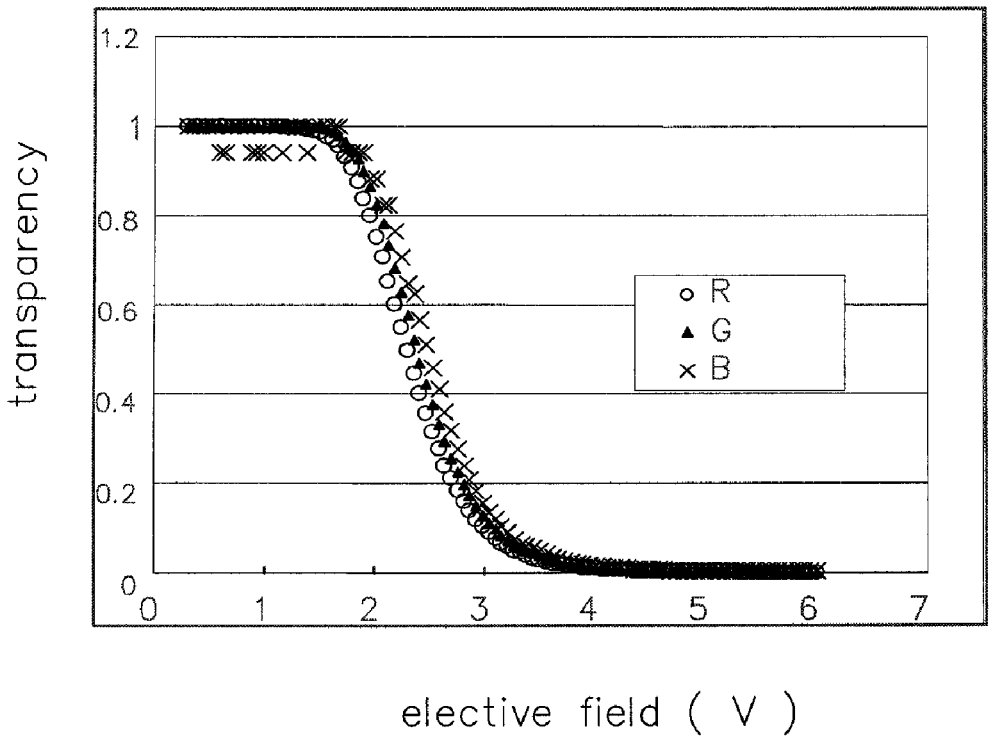
FIG. 1 (Prior Art)
FIG. 1 is a plot showing the relationship of applied electric fields and transparency in a traditional RGB pixel device.
Figure 2:
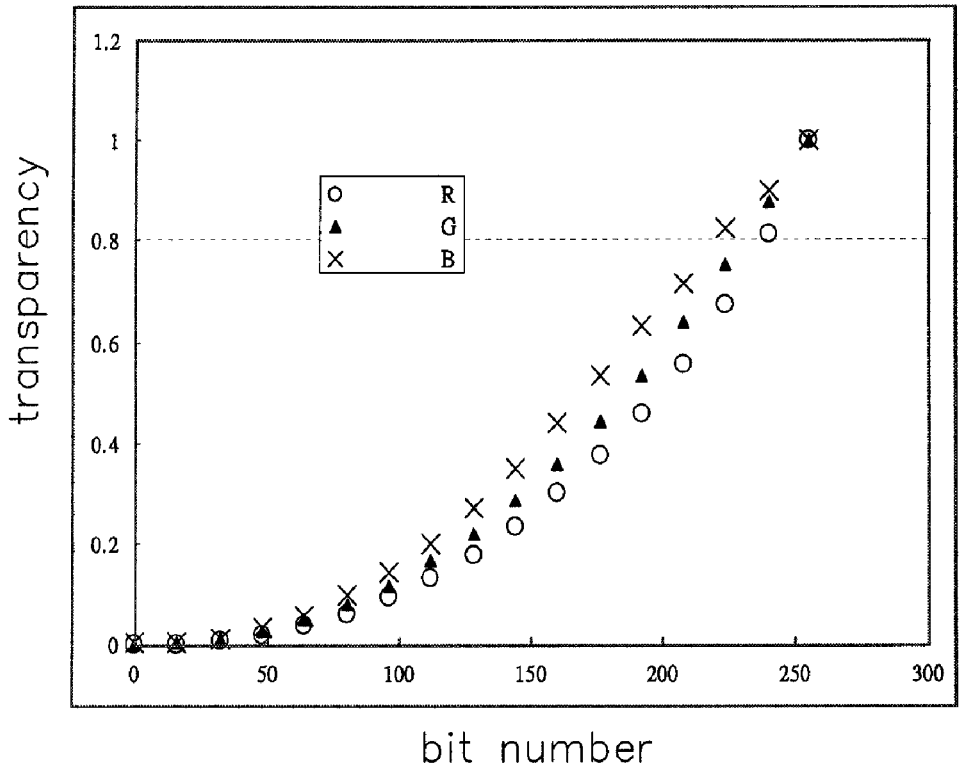
FIG. 2 (Prior Art)
FIG. 2 is a plot showing gamma curves of a traditional RGB pixel device of FIG. 1.
Figure 3:
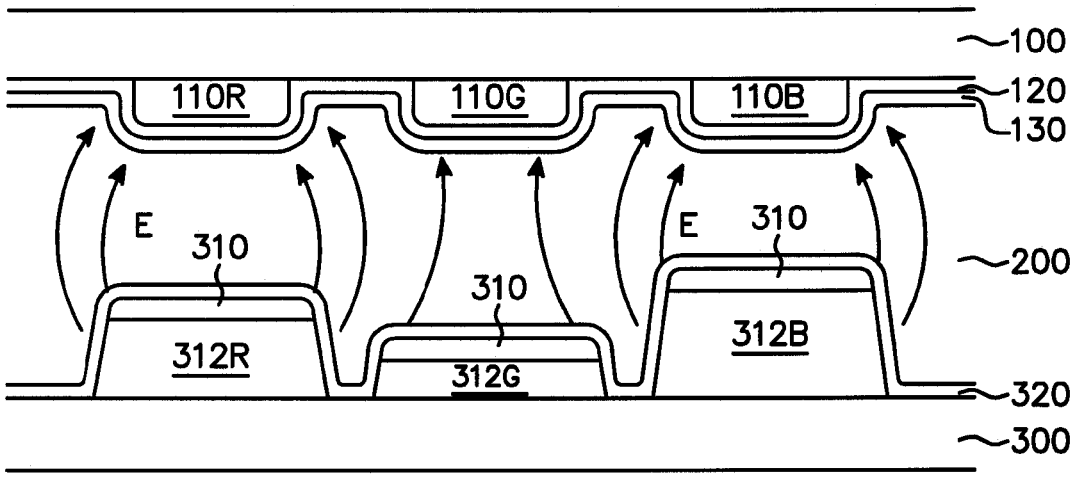
F I G . 3 ( Prior Art )
FIG. 3 depicts a schematic view of RGB pixel devices by using a traditional gamma correction method to adjust the thickness of LC layer.

2. In a traditional gamma correction apparatus of FIG. 3, the thicknesses of organic layers 312 or color filter layers 110 need to be adjusted so as to vary the transparency of LC layer 200. Because no organic layers 312 are demanded in accordance with the present invention, the previous described problems resulted from the formation of transparency organic layer 312 can thus be solved.

3. By contrast to the conventional gamma correction method of adjusting digital displaying signals, the method in accordance with the present invention only deals with the analog signals, so as to prevent the sacrificing of displaying signal levels.

4. During the conversion progress from digital signals to analog ones, the conventional method needs three adjustable reference electric level circuits, and each of which needs an enormous amount of adjustable levels which will definitely complicates the LC driving circuit design. On the other hand, only one reference electric level circuit (not shown) is needed to establish a relationship between digital signals and analog signals in accordance with the present invention, and the remaining errors is adjusted by the adjusting circuits 16 to meet the white balance requirement. For the adjusting circuits 16 only deal with the remaining errors, the amount of adjustable levels of the adjusting circuit 16 is then much fewer than that of the reference electric level circuit, and thus the design and fabrication cost of the adjusting circuit 16 can be much acceptable.

With the example and explanations above, the features and spirits of the invention will be hopefully well described. Those skilled in the art will readily observe that numerous modifications and alterations of the device may be made when retaining the teaching of the invention. Accordingly, the above disclosure should be construed as limited only by the metes and bounds of the appended claims.

What is claimed is:

1. A gamma correction apparatus connecting to an LCD panel for adjusting RGB gamma curves of said LCD panel, comprising:

a digital to analog converter (DAC) for receiving RGB digital signals and generating RGB analog signals to relative pixel devices through signal lines on said LCD panel;

at least one compensating circuit electrically connecting to said DAC and said signal lines for adjusting said analog signals to correct displaying brightness of said pixel devices;

at least one adjusting circuit electrically connecting to said compensating circuits for directly controlling said compensating circuits; and a brightness detector for measuring RGB illumination levels of said LCD panel and for having said RGB illumination levels respond to said at least one adjusting circuit.

2. The gamma correction apparatus of claim 1, wherein said adjusting circuit has an adjustable resistor for providing a changeable output to adjust said compensating circuits.

3. The gamma correction apparatus of claim 1, wherein each said adjusting circuit controls said compensating circuits relating to a set of said pixel devices of the same displaying color.

4. The gamma correction apparatus of claim 1, wherein said DAC and said compensating circuits are provided on a source driver IC of said LCD panel.

5. The gamma correction apparatus of claim 1, wherein said adjusting circuit is provided on a glass substrate by using low temperature polysilicon fabrication technique or on PCB.

6. The gamma correction apparatus of claim 1, wherein said adjusting circuits and said compensating circuits are provided in a single electric circuit.

7. The gamma correction apparatus of claim 6, wherein said single electric circuit is formed on a source driver IC.

8. The gamma correction apparatus of claim 1, wherein said compensating circuit is disposed between said DAC and said signal lines for receiving said analog signals from said DAC.

9. The gamma correction apparatus of claim 1, wherein said compensating circuit is disposed between the DAC and the signal lines, and is electrically connected to the rear end of the DAC and the front end of the signal lines.

10. The gamma correction apparatus of claim 1, wherein said compensating circuit is disposed between the DAC and the signal lines, and is directly connected to the DAC and the signal lines.

11. A gamma correction apparatus connecting to an LCD panel for adjusting RGB gamma curves of said LCD panel, comprising:

a digital to analog converter (DAC) for receiving RGB digital signals and generating RGB analog signals to relative pixel devices through signal lines on said LCD panel;

at least one compensating circuit electrically connecting to said DAC and said signal lines for adjusting said analog signals to correct displaying brightness of said pixel devices;

at least one adjusting circuit electrically connecting to said at least one compensating circuit, wherein said at least one compensating circuit is directly received a signal from said at least one adjusting circuit to adjust an output values of said analog signals of said at least one compensating circuit; and a brightness detector for measuring RGB illumination levels of said LCD panel and for having said RGB illumination levels respond to said at least one adjusting circuit.

12. The gamma correction apparatus of claim 11, wherein said adjusting circuit has an adjustable resistor for providing a changeable output to adjust said compensating circuits.

13. The gamma correction apparatus of claim 11, wherein each said adjusting circuit controls said compensating circuits relating to a set of said pixel devices of the same displaying color.

14. The gamma correction apparatus of claim 11, wherein said DAC and said compensating circuits are provided on a source driver IC of said LCD panel.

15. The gamma correction apparatus of claim 11, wherein said adjusting circuit is provided on a glass substrate by using low temperature polysilicon fabrication technique or on PCB.

16. The gamma correction apparatus of claim 11, wherein said adjusting circuits and said compensating circuits are provided in a single electric circuit.

17. The gamma correction apparatus of claim 16, wherein said single electric circuit is formed on a source driver IC.

18. The gamma correction apparatus of claim 16, wherein said signal lines is directly received another signal from said at least one compensating circuit.

* * * * *